US009505043B2

(12) United States Patent
Liebsch

(10) Patent No.: US 9,505,043 B2
(45) Date of Patent: Nov. 29, 2016

(54) LABORATORY FUME CUPBOARD

(75) Inventor: Jurgen Liebsch, Lindenberg (DE)

(73) Assignee: WALDNER LABOREINRICHTUNGEN GMBH & CO. KG, Allgau (DE)

( * ) Notice: Subject to any disclaimer, the term of this patent is extended or adjusted under 35 U.S.C. 154(b) by 880 days.

(21) Appl. No.: 13/263,891

(22) PCT Filed: Apr. 16, 2010

(86) PCT No.: PCT/EP2010/055074

§ 371 (c)(1),
(2), (4) Date: Oct. 11, 2011

(87) PCT Pub. No.: WO2010/119135

PCT Pub. Date: Oct. 21, 2010

(65) Prior Publication Data

US 2012/0100789 A1 Apr. 26, 2012

(30) Foreign Application Priority Data

Apr. 17, 2009 (DE) ..... 10 2009 002 458

(51) Int. Cl.
*B08B 15/00* (2006.01)
*B08B 15/02* (2006.01)

(52) U.S. Cl.
CPC ..... *B08B 15/023* (2013.01)

(58) Field of Classification Search
CPC ..... B08B 15/023
USPC ..... 454/49, 57, 56
See application file for complete search history.

(56) References Cited

U.S. PATENT DOCUMENTS

| | | | | | |
|---|---|---|---|---|---|
| 3,237,548 | A | * | 3/1966 | Bayern | 454/59 |
| 3,254,588 | A | * | 6/1966 | Truhan | 454/58 |
| 3,318,227 | A | * | 5/1967 | Nelson et al. | 454/59 |
| 3,408,914 | A | * | 11/1968 | Bayern | 454/59 |
| 3,747,505 | A | * | 7/1973 | Turko | 454/59 |
| 3,944,405 | A | * | 3/1976 | Van Calsteren et al. | 55/338 |
| 4,280,400 | A | * | 7/1981 | Longworth | 454/57 |
| 4,409,890 | A | * | 10/1983 | Longworth | 454/57 |
| 5,065,668 | A | * | 11/1991 | Mitchell et al. | 454/57 |

(Continued)

FOREIGN PATENT DOCUMENTS

| | | |
|---|---|---|
| JP | 2005-502856 | 1/2005 |
| JP | 2008-114179 | 5/2008 |

(Continued)

OTHER PUBLICATIONS

International Search Report for PCT/EP2010/055074, which is a corresponding PCT application, that cites U.S. Pat. No. 3,318,227, U.S. Pat. No. 3,254,588, DE 10240019, and DE 3939063.

(Continued)

*Primary Examiner* — Steven B McAllister
*Assistant Examiner* — Jonathan Cotov
(74) *Attorney, Agent, or Firm* — Arc IP Law, PC; Joseph J. Mayo

(57) ABSTRACT

The invention relates to a laboratory fume cupboard (100) comprising, connected in a moveable manner with a laboratory housing (60), a sash (30) for opening and closing a fume cupboard interior, in which between the sash (30) and a side post (10) of the laboratory housing (60) an air opening (70) is provided which is designed for producing wall flows in the interior of the fume cupboard.

8 Claims, 4 Drawing Sheets

(56) References Cited

U.S. PATENT DOCUMENTS

| | | | | |
|---|---|---|---|---|
| 5,167,572 | A * | 12/1992 | Etkin | 454/57 |
| 5,556,331 | A * | 9/1996 | Bastian | 454/56 |
| 6,080,058 | A * | 6/2000 | Coe et al. | 454/56 |
| 6,302,779 | B1 * | 10/2001 | Ryan et al. | 454/61 |
| 6,461,233 | B1 * | 10/2002 | Gilkison et al. | 454/57 |
| 6,582,292 | B1 * | 6/2003 | Bastian | 454/59 |
| 7,022,151 | B2 * | 4/2006 | Ono | 55/385.2 |
| RE40,276 | E * | 4/2008 | Hunter et al. | 454/58 |
| 2004/0242143 | A1 * | 12/2004 | Gartner et al. | 454/58 |
| 2008/0278040 | A1 * | 11/2008 | McCarthy et al. | 312/209 |

FOREIGN PATENT DOCUMENTS

| | | |
|---|---|---|
| WO | 03/024631 | 3/2003 |
| WO | 2010/119135 A1 | 10/2010 |

OTHER PUBLICATIONS

Japanese Office Action, Dated Sep. 30, 2013, 11 pages including translation of same.

* cited by examiner

LABORATORY FUME CUPBOARD

The present invention relates to a laboratory fume cupboard.

Laboratory fume cupboards are an essential component of laboratories. All laboratory work in which gases, vapours, volatile particles or liquids are used in hazardous quantities and concentrations must be carried out in laboratory fume cupboards in order to protect the laboratory personnel.

In the past the parameter indicating the safety and/or efficiency of laboratory fume cupboards was the volumetric air outflow. In a departure from this definition, with the introduction of DIN 12924 part I in 1991 the efficiency of laboratory fume cupboards was determined by means of a limit value for the escape of test gas. This limit value indicates the escape safety (containment) of a laboratory fume cupboard. Even though DIN 12924 part 1 has in the meantime been replaced by European standard DIN EN 14175, numerous innovations in the field of laboratory fume cupboards relate to optimisation of the energy efficiency with which a laboratory fume cupboard can be operated while at the same time observing the standardised escape safety. The energy efficiency is largely determined by the minimum volumetric air flow. Significant energy savings can also be made by reducing the minimum volumetric air flow.

To reduce the volumetric air flow supportive flow technology has been developed. Supportive flow technology uses airfoil-shaped profiles which are provided on the side posts, the front edge of the fume cupboard worktop as well as the lower edge of the sash. The in-flowing air is also guided through the side post and front edge designed as hollow profiles, and is then, with the sash partially or fully open, blown into the interior of the fume cupboard through slit-like openings.

After emerging from the slit-like opening the air flows along the base area and the side walls of the fume cupboard interior in order to prevent an accumulation of toxic gases, vapours or volatile particles in the vicinity of the wall surfaces and the base area. These wall and base flows assure a flow speed in the area of the wall surfaces and base area which is not equal to zero which strongly reduces wall friction effects.

By way of these supportive flows the minimum exhaust air quantity at which the escape safety of the laboratory fume cupboard still meets the standard regulations could be considerably reduced by way of a partially or fully opened sash. They also prevent dangerous reflux areas as there is no break in the flow in the area of the wall surfaces and base, more particularly in the area of contour changes. An example of a laboratory fume cupboard equipped with supportive flow technology is described in DE 101 46 000 A1.

In laboratory fume cupboards without supportive flow technology, i.e. in laboratory fume cupboards without an optimised flow, a reduction in the minimum exhaust volumetric flow can also be achieved through the incorporation of requirement-dependent air volume regulators. As sashes do not usually close off laboratory fume cupboards in an airtight manner, the laboratory fume cupboards only have small openings toward the laboratory when the sash is closed so that only a relative small minimum exhaust air volumetric flow is required to guarantee the standardised escape safety. These requirement-dependent air volume regulations control the required minimum exhaust air volumetric flow as a function of the position of the sash, whereby further energy saving can also be achieved in laboratory fume cupboards without supportive flow technology.

Further laboratory fume cupboards are described in GB 2 331 358 A1, DE 103 38 284 B4, DE 295 00 607 U1 and EP 1 977 837 A1. The fume cupboard described in GB 2 331 358 A1 has air slits on its front through which room air is drawn into the working area of the laboratory fume cupboard. This additionally drawn-in room air ensures a more even velocity distribution of the exhaust air in the working area of the fume cupboard. The side post of the fume cupboard described in DE 103 38 284 B4 has a profile element accommodating the side wall of the working area which at the front is at a distance from the guide mechanism of the sash. Room air is drawn into the working area through this slit formed by this gap. Due to the geometry of the slit the room air emerges into the working area perpendicularly to the side walls in the form of free flows. DE 295 00 607 U1 describes a mobile laboratory fume cupboard which can be looked into from all sides for examination or teaching purposes. It has a front and a side sash. When the side sash is closed room air can penetrate through a gap between the side sash and the worktop into the working area of the fume cupboard. The fume cupboard described in EP 1 977 837 A1 has a hollow profile on the lower edge of the sash. This hollow profile has an opening so that room air can be drawn into the working area of the fume cupboard.

The aim of the present invention is to create a laboratory fume cupboard in which the energy efficiency is further improved. More particularly it is the aim of the present invention to provide a laboratory fume cupboard which can also be operated without supportive flow technology with a reduced minimum exhaust volumetric air flow while at the same time observing the standardized escape safety.

This is achieved through a laboratory fume cupboard exhibiting the combination of features of claim 1.

Preferred embodiments of the invention are the subject matter of dependent claims 2 to 9.

In accordance with the invention the laboratory fume cupboard comprises a sash movably connected to a laboratory casing for opening and closing the interior of a fume cupboard. Between the sash and a side post of the laboratory casing an air opening is provided which is designed to generate wall flows in the interior of the fume cupboard. Even when the sash is closed, air is drawn through the air opening into the interior in order to create wall flows which reduce the wall friction effects and transport hazardous substances toward the back and out of the interior of the fume cupboard. In this way a reduction in the minimum volumetric air flow is achieved which has a positive effect on the energy balance of the laboratory fume cupboard.

The advantageous effect of the air opening is not only seen in laboratory fume cupboards equipped with supportive flow technology. Even without blowing supportive flows into the interior of the fume cupboard, room air can enter the interior of the fume cupboard through the air opening as a result of the suction effect of the exhaust air and flow along the walls of the interior of the fume cupboard to the deflector wall. In this way even in a laboratory fume cupboard without supportive flow technology the minimum volumetric air flow is reduced.

In addition, there is a further effect relating to the safety of the laboratory fume cupboard. As the sash does not form a hermetic seal with the fume cupboard casing, when the sash is closed room air flows at high speed into the interior of the fume cupboard through the residual openings frequently found at the top and bottom of the sash. When the sash is closed a uniform volumetric flow distribution in the interior of the fume cupboard is no longer present. The resulting vortices and overall non-directional flow results in released hazardous substances remaining in the interior of the fume cupboard for longer. In the event of smoke or mist this can result in restriction of the laboratory personnel's view into the interior of the fume cupboard. Furthermore, hazardous substances can accumulate in increased concentrations in the front area of the interior of the fume cupboard, i.e. directly behind the sash with the risk of hazardous substances emerging from the interior of the fume cupboard on opening the sash.

The air gap provide in accordance with the invention between the side post and sash increases the safety of the fume cupboard in that the inflow is evened out at the sash, but in particular in the area of the side walls, with the result that the formation of non-directional or turbulent flows in the interior of the fume cupboard is prevented when the sash is closed. The risk of hazardous substance escaping when the sash is then opened is thus drastically reduced.

As the supportive flow effect is also achieved without supportive flow technology by the air opening or air gap, the air supply for the supportive flow technology can be switched off when the sash is closed, which results in a further energy saving. In addition, the noise level of the laboratory fume cupboard is reduced by switching off the air to the fans supplying air to the supportive flow openings.

Preferably the air opening is designed in the form of a nozzle whereby the above effect is intensified further.

The air opening is also preferably designed so that its width increases in the horizontal direction from the interior of the fume cupboard to the exterior of the fume cupboard.

According to a preferred embodiment of the invention the geometry of the air opening is such that a hypothetical flow of particles or liquid flowing in a straight line perpendicularly to the surface of the sash cannot pass from the interior of the fume cupboard to the exterior of the fume cupboard. This geometry ensures that in spite of the gap between the sash and the fume cupboard post, the primary function of the laboratory fume cupboard, namely protection against splashes and splinter, is preserved. It is important that no particles or liquids can pass from the interior of the fume cupboard to the external of the fume cupboard. To guarantee the operation of the fume cupboard this should be achieved through this preferred design.

In accordance with a preferred form of embodiment of the invention a vertical outer edge of the frame section of the sash facing the interior of the fume cupboard is in the horizontal direction perpendicularly aligned to the surface of the sash with a vertical outer edge of the side post.

Preferably the outer edge of the frame section of the sash is aligned with the outer edge of the side post over the entire length of the frame section. The alignment of these two edges assures protection against splashes and splinters over the entire height of the sash.

The outer edge of the side post can be provided on an airfoil-shaped flow surface of the side post.

The side post can also be designed as a frame profile with a first chamber and a second chamber, whereby the second chamber has at least one air outlet. An element throttling the air flow through the chambers can be arranged between the first chamber and the second chamber. By way of the element throttling the air flow, upstream of the throttle element a pressure can be built up in the frame profile, as a result of which the pressure distribution at the air outlet is evened out along the frame profile. This ensures even blowing out of the supportive or supplied air through the air opening, which, in turn ensures even volumetric flow distribution in the entire fume cupboard, but particularly in the area of the wall surfaces in the interior of the fume cupboard. The first chamber forms a kind of preliminary chamber in which a pressure cushion is produced which ensures an even pressure distribution in the second blow out chamber and thus even blowing out. In addition, the time the supplied air remains in the hollow space of the frame profile is also increased by the throttle element.

Preferably the laboratory fume cupboard is provided with a supportive flow technology system at the front edge in the area of the worktop and supportive flow technology system in the side post. Because of the gap provided between the sash and the side post the supportive air emerging from the side post profile can enter the interior of the fume cupboard even with the sash closed or the horizontal sliding window open, which has an advantageous effect on the energy efficiency of the laboratory fume cupboard.

A preferred embodiment of the invention is described below with reference to the attached drawings.

Figure 1:
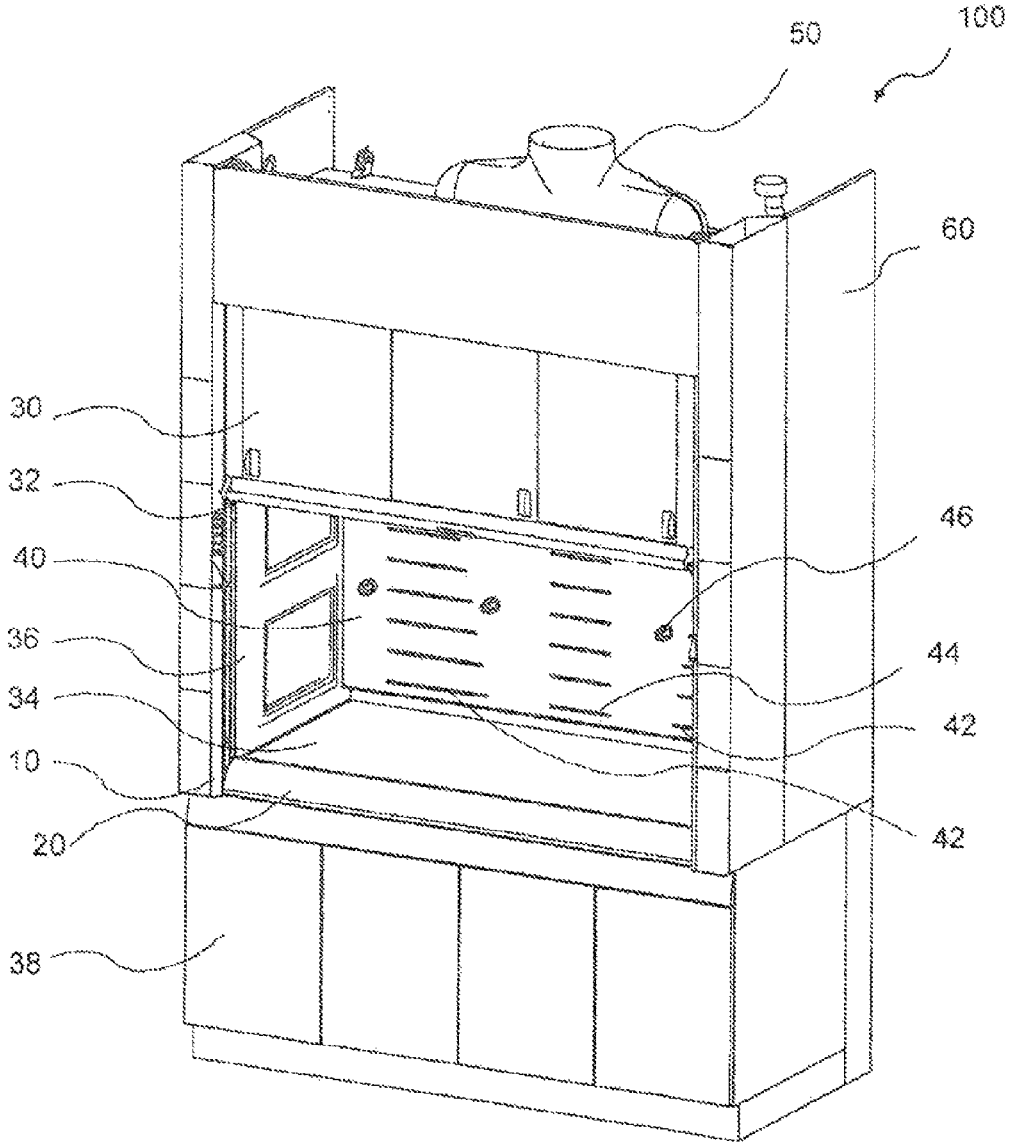
FIG. 1 shows a perspective front view of a laboratory fume cupboard equipped with supportive flow technology

The laboratory fume cupboard 100 shows in a perspective view in FIG. 1 has an fume cupboard interior which at the rear is defined by a deflector 40, laterally by side walls 36, at the front by a closable sash 30 and at the top by a ceiling 48. The sash 30 is designed in multiple parts so that several vertically moveable window elements run telescopically one after the other in the same way when opening and closing the sash. When the sash is closed the lowest window element has an airfoil profile 32 on its front edge. The sash 30 also has horizontally moveable window elements which also give the laboratory personnel access to the interior of the fume cupboard when the sash 30 is closed.

At this point it is pointed out that the sash 30 can also be designed as a two-part sliding window, both parts of which can moved in opposite directions vertically. In this case the counter-running parts are connected via cables or belts and deflecting rollers with weights counterbalancing the weight of the sash.

Between the deflector 40 and the rear wall 62 (FIG. 2) of the fume cupboard housing 60 there is a channel leading to an exhaust air collection channel 50 at the top of the laboratory fume cupboard. The exhaust air collection channel 50 is connected to an exhaust air device installed on the building side.

Beneath the worktop 34 of the interior of the fume cupboard there is a furnishing unit which is used as a storage space for various laboratory equipment.

The side posts of the laboratory fume cupboard have airfoil profiles 10 on the inflow side. Equally, the front edge, which is in the area of the worktop 34 or a part thereof, is also provided with an airfoil profile 20 on the inflow side. The airfoil-like profile geometry ensures a low-turbulence or turbulence-free inflow of room air into the interior of the fume cupboard when the sash is partially or fully open. If the sash has an air gap in the area of the airfoil profile the effect of low-turbulence or turbulence-free inflow of room air into the interior of the fume cupboard is also achieved when the sash is closed.

The laboratory fume cupboard 100 shown in FIG. 1 is should be considered purely as an example as the invention can be used in various types of laboratory fume cupboards, for example, table-top fume cupboards, low-ceiling table-top fume cupboards or walk-in fume cupboard. These fume cupboards also meet the requirements of European standards DIN EN 14175 applicable on the day of application. The fume cupboards may also meet the requirements of other standards, such as ASHRAE 110/1995 which is valid for the USA.

Figure 2:
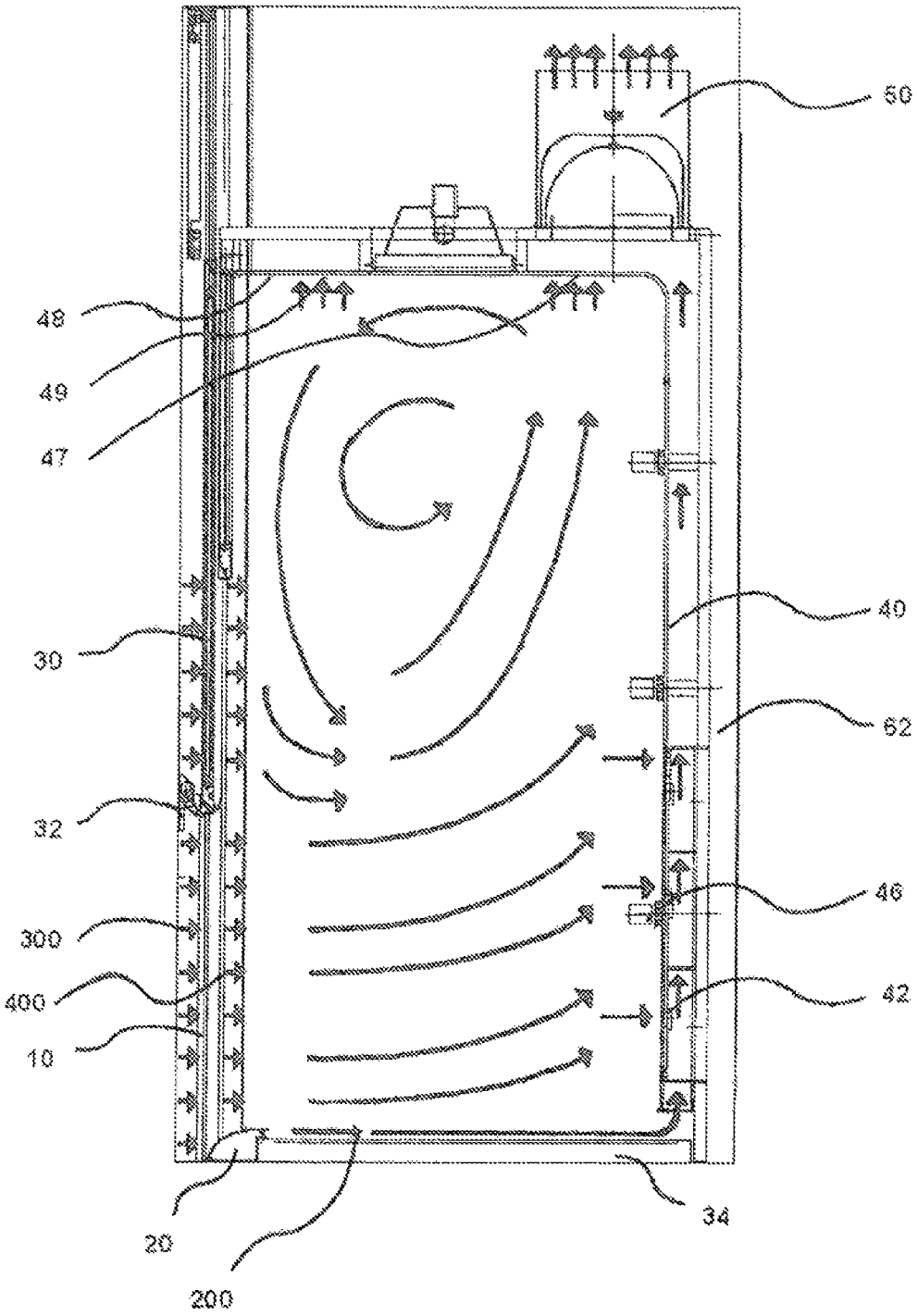
FIG. 2 shows a cross-section through the laboratory fume cupboard shown in FIG. 1 in which flow arrows indicate the effect of the invention with a partially opened sash.

In a very simplified manner FIG. 2 shows the flow of the inflowing room air 300, the supportive air 200, 400 and the exhaust air within the interior of the fume cupboard and in the channel between the deflector 40 and the rear wall towards the exhaust air collection channel 50.

At its base the deflector 50 is at a distance from the worktop 34 of the interior of the fume cupboard and from the rear wall 62 of the housing, as a result of which an exhaust air channel is formed. The deflector 40 also has a number of longitudinal openings 43, 44 through which the exhaust air can be drawn out of the interior of the fume cupboard. Further openings 47, 49 are provided on the ceiling 48 in the interior of the fume cupboard through which, in particular, light gases and vapours can be directed to the exhaust air collection channel 50. Although not shown in FIG. 1 and FIG. 2, the deflector 40 can be at a distance from the side walls 36 of the fume cupboard housing. Through a thus formed exhaust air channel, exhaust air can also be directed through the deflector into the exhaust air channel.

As shown in FIG. 2, through the invention room air 300 can also flow into the interior of the fume cupboard above the lower edge of the sash 30 designed as an airfoil profile when the sash 30 is partially open. This is achieved through the gap 70, formed between the sash 30 and the side posts 10, the geometry of which is described in more detail with reference to FIG. 4.

On the deflector 40 a number of supports 46 can be seen into which rods can be detachably clamped which act as holders for test assemblies in the interior of the fume cupboard.

Figure 3:
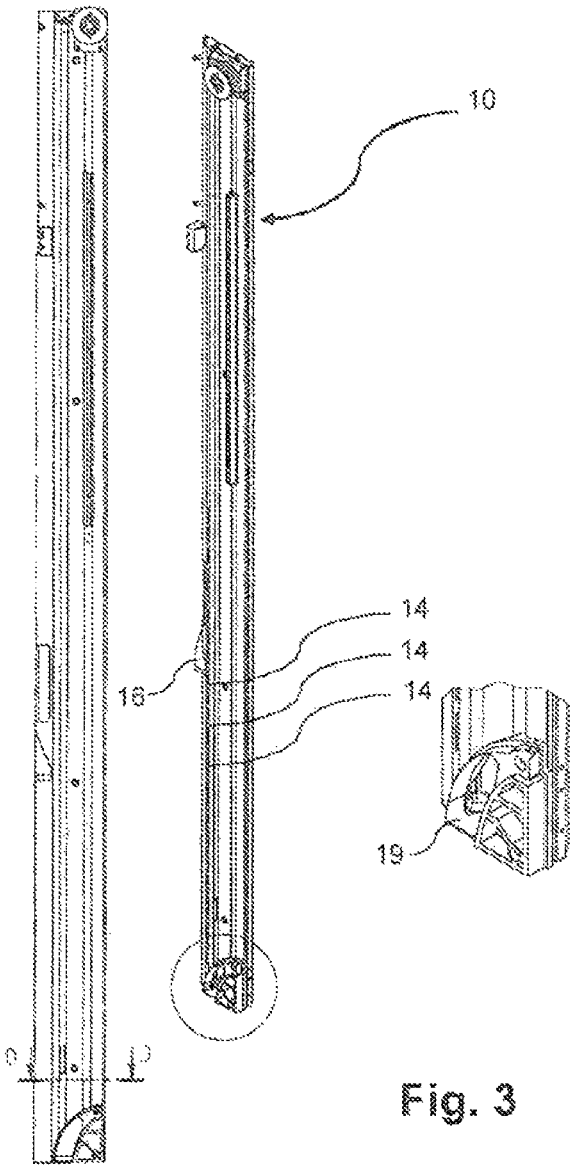
FIG. 3 shows a view of a frame profile intended for use as a side post of a laboratory fume cupboard with supportive flow technology and FIG. 4 shows a cross-sectional view of the frame profile shown in FIG. 3 along line D-D and a sash.

FIG. 3 shows view of a side post frame profile 10, in the illustration on the left in a side view and in the illustration in the middle in a perspective view. The circled area in the middle illustration is shown enlarged in the illustration on the right.

In addition to the guide for the vertically moveable sash and stop 15 which defines the fully open position of the sash, the frame profile 10, which forms the section of the side post facing the sash 30, has an opening 19 in the end section on the bottom, through which the inflowing air is blown under pressure into the frame profile 10. This opening 19 leads to a first chamber 12 (FIG. 4) which runs the entire length of the frame profile and which is connected in fluid terms with a second chamber 13. The second chamber 13 also runs the entire length of the frame profile 10 and has a number of slit-like outlet opening 14 through which the blow-in inflowing air is blow out in the form of supportive flows 400.

At this point it is pointed out that such frame profiles 10 are provided on both sides of the sash 30 and that the shape of the outlet openings does not have to be slit-like. It is also conceivable for only one outlet opening to be provided which is in the form of one continuous slit.

Figure 4:
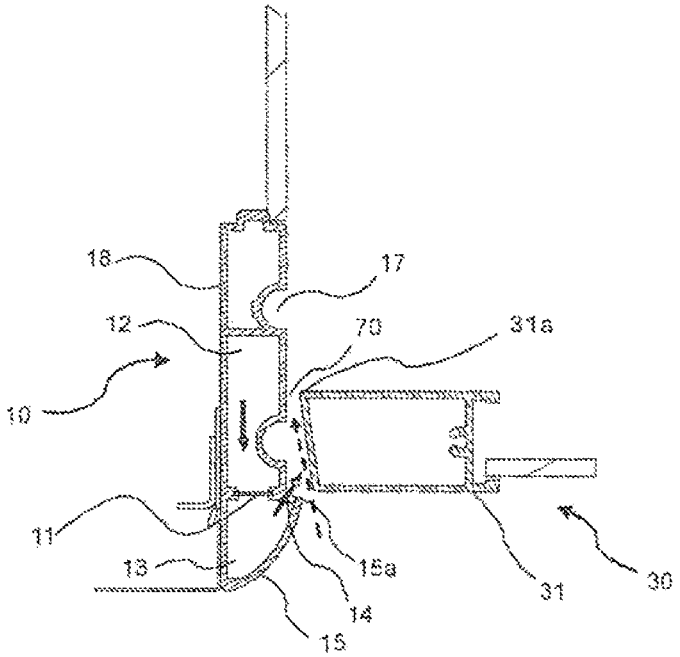

With reference to FIG. 4 an air opening or slit 70 is provided between the sash 30 and the frame profile 10 which is part of the side post of the laboratory fume cupboard 60. More precisely, the air opening is between the left, oblique outer edge of the sash shown in FIG. 4 and the section of frame profile 10 facing the sash in which the guide (lower bulge) for the sash 30 is provided. The geometry of the air opening 70 is selected so that the penetration of particles or fluids is prevented from the interior of the fume cupboard in a direction essentially perpendicular to the surface which in FIG. 4 is on the upper side of the frame section 31 of the sash 30. For this purpose the vertically running outer edge 31*a* is aligned with the vertically running outer edge 15*a* of the frame profile 10.

In the example shown in FIG. 4 the air opening 70 is nozzle or funnel-shaped with its width increasing from the interior to the exterior of the fume cupboard (in FIG. 4 from top to bottom).

This geometry of the air opening 70 allows a reduction in wall friction effects in the interior of the fume cupboard as with the sash 30 closed and horizontal slide windows open—the horizontal sliding windows are shown as individual window elements in FIG. 1—the supportive flow (indicated in FIG. 4 with a continuous arrow) emerging from the outlet opening 14 of the frame profile 10 moves towards the rear in the interior of the fume cupboard in the form of a wall flow and transports hazardous substance toward the rear and out of the interior of the fume cupboard. The nozzle-shaped air opening 70 between the frame section 31 of the sash 30 and the frame profile 10 of the fume cupboard post also ensures adequate splash and splinter protection.

The advantageous effect of the nozzle-shaped air opening 70 is not only seen in laboratory fume cupboard equipped with supportive flow technology. Even with supportive flows being blown out through the frame profile 10, room air (indicated by a dashed arrow in FIG. 4) can enter the interior of the fume cupboard through the air opening 70 due to the suction effect of the exhaust air and travel along the walls in the interior of the fume cupboard to the deflector. In this way, even in a laboratory fume cupboard without supportive flow technology the minimum exhaust air volumetric flow is reduced, while observing the standardised escape safety, which in turn has an advantageous effect on the energy efficiency of the laboratory fume cupboard.

There is also a further effect relating to the safety of the laboratory fume cupboard. As the sash is of course not hermetically or air-tight sealed, when the sash is closed due to the suction effect of the exhaust air in the interior of the fume cupboard, room air flows into interior of the fume cupboard at high speed through the residual openings frequently present above and below the sash. This air flowing in at high speed when the sash is closed impairs the volumetric flow distribution in the interior of the fume cupboard. This produces vortices which lead to released hazardous substances remaining in the interior of the fume cupboard for a longer period. In the event of smoke of mist this can restrict the laboratory personnel's visibility in the interior of the fume cupboard. In addition, hazardous substance in the front area of the interior of the fume cupboard, i.e. directly behind the sash can accumulate in higher concentrations with the risk of the hazardous substances escaping from the interior of the fume cupboard on subsequent opening of the sash.

The air gap 70 provided between the side points and sash increases the safety of the fume cupboard in that the inflow is provided circumferentially on the sash 30 if the area of the airfoil profile 32 the sash 30 also has an air gap (not shown) extending over the width of the sash 30, but if not the inflow is evened out in particular in the area of the side walls 36 of the interior of the fume cupboard. This results in the prevention of non-directional and/or turbulent flow in the interior of the fume cupboard when the sash is close 30. This drastically reduces the risk of escape of hazardous substance on subsequent opening of the sash 30.

As the supportive flow effect is also achieved without supportive flows as a result of the air opening or air gap 70, when the sash 30 is closed the air supply for the supportive flows 200, 400 can, for example, be switched off which achieves a further energy saving. In addition, the noise level of the laboratory fume cupboard is reduced by switching off the fans which convey the air to the supportive flow openings 14.

As can also be seen in the cross-sectional view in FIG. 4, the supportive flow shown by the continuous arrow moves in a direction from the frame profile 10 which is at an acute angle to the inner surface of the frame profile 10 and thus to the wall surface 36 of the interior of the fume cupboard. This direction corresponds approximately to the tangent on the airfoil profile-shaped inflow surface 15 (for the room air) on the front inner side of the frame profile 10. The supportive flow can also be blown out of the frame profile 10 in this direction or parallel to the side walls of the working area.

Between the first chamber 12 and the second chamber 13 of the frame profile 10 there is an element 11 with throttles the air flow, for example a throttle plate or a permeable membrane. Through the throttle element 11 a pressure is produced in the first chamber 12 which is sufficient to allow even air outlet from all the air outlet openings 14 arranged vertically along the frame profile 10. The even air outlet ensures an even volumetric flow distribution along the wall surfaces 36 of the interior of the fume cupboard, which in turn has an advantageous effect on the minimum exhaust air volumetric flow. The throttle element 11 can extend over the entire length of the frame profile 10, but at least over the length over which the air outlet openings 14 are distributed.

In the cross-sectional view in FIG. 4 the frame profile is designed as a one-piece profile 10. The semicircular bulges 17 on the inner side are guides for the sash 30. Section 18 of the first chamber 12 located laterally inside is for fastening to the housing of the fume cupboard. For fastening the throttle element 11 between the first and the second chamber 12, 13 there are two webs each with a groove corresponding to the thickness of the throttle element 11. In this way the throttle element 11 can be pushed through with its end into the frame profile 10 during assembly.

The throttle element 11 can have openings with a spacing and/or size that varies along the frame profile 10. More particularly, the spacing and/or the size of the openings in the throttle element 11 can increase or decrease with increasing distance from the worktop 34 in order to guarantee even blowing out of the supportive flows 400 over all the outlet openings 14. In other words, as the inlet point of the inflow air in this example of embodiment of the frame profile 10 is at the bottom, i.e. in the area of the worktop 24, through a specifically selected arrangement and size of the openings in the throttle element and/or through specific changes in the throttle cross-section, the pressure distribution between the two chambers 12, 13 and the speed distribution of the blown out supportive air 400 can be changed along the frame profile 10.

If the inlet point for the inflow air is in the upper part of the frame profile 10, the throttle cross-section of the throttle element 11 can be reversed accordingly along the frame profile 10. Equally the throttle cross-section of the throttle element 21 can be adapted in as desired in the frame profile 20.

Specific selection of the throttle cross-section of the throttle element 11 arranged within the frame profile 10 advantageously influences the volumetric flow distribution in the interior of the fume cupboard, more particularly on the wall surfaces 36 and base area 34. To optimise this volumetric flow distribution the drawing out openings or slits 42, 44, 47, 49 provided on the deflector 40 and on the ceiling 48 in the interior of the fume chamber can be adapted accordingly. For this reason the slits 42 in provided on the wall side in the deflector in the area of the worktop are longer than the slits 44 in the middle of the deflector 40 (see FIG. 1). Through the increased inflow of supportive air 200, 400 in the area of the worktop 34 and in the area of the wall surfaces 36 of the interior of the fume cupboard more exhaust air and thus hazardous substances are transported away through the larger slits 42.

Accordingly extraction opening 47 at the rear of the ceiling 48 can be larger than openings 49 facing the sash 30.

What is claimed is:

1. A laboratory fume cupboard comprising:

two side posts comprising a first side post and a second side post opposite to and across from said first side post; and wherein each of said first side post and said second side post comprise an outer edge surface;

a sash with a left edge and a second edge opposite to and across from said left edge, wherein said sash is moveably connected to the two side posts to open and close a fume cupboard interior, wherein said sash is provided between said first side post and said second side post, wherein a first air opening is provided into the interior of the fume cupboard, wherein the first air opening is defined by the left edge of the sash and the outer edge surface of the first side post, wherein a second air opening is provided into the interior of the fume cupboard, wherein the second air opening is defined by the opposing edge of the sash and the outer edge surface of the second side post, wherein the air openings allow entry of room air from an exterior of the fume cupboard into the interior of the fume cupboard when the sash is closed, wherein the air openings are constructed to produce wall flows along lateral side walls of the fume cupboard interior, and wherein said first air opening is provided directly between the left edge of the sash and the outer edge surface of the first side post, and wherein said second air opening is provided directly between the opposing edge of the sash and the outer edge surface of the second side post.

2. The laboratory fume cupboard in accordance with claim 1, wherein the air openings are nozzle-shaped.

3. The laboratory fume cupboard in accordance with claim 1, wherein the air openings become broader in a horizontal direction from the interior to the exterior of the fume cupboard.

4. The laboratory fume cupboard in accordance with claim 1, wherein the geometry of the air openings is such that a hypothetical particle or fluid flow running essentially in a straight line perpendicularly to the surface of the sash cannot pass from the interior to the exterior of the fume cupboard.

5. The laboratory fume cupboard in accordance with claim 1, wherein at each air opening, a vertical outer edge of a frame section of the sash facing the interior of the fume cupboard is aligned in a horizontal direction perpendicular to the surface of the sash with a vertical outer edge of a side post of the two side posts.

6. The laboratory fume cupboard in accordance with claim 5, wherein the vertical outer edge of the frame section of the sash is aligned with the vertical outer edge of the side post of the two side posts over the entire length of the frame section.

7. The laboratory fume cupboard in accordance with claim 5, wherein the vertical outer edge of the side post of the two side posts is provided on an airfoil-shaped inflow surface of the side post.

8. The laboratory fume cupboard in accordance with claim 1, wherein each of the two side posts is constructed as a frame profile with a first chamber and a second chamber, wherein the second chamber has at least one air outlet opening, and wherein between the first chamber and the second chamber an element is arranged for throttling the air flow through the chambers.

* * * * *